US006340047B1

(12) United States Patent
Frey

(10) Patent No.: US 6,340,047 B1
(45) Date of Patent: Jan. 22, 2002

(54) CORE TIED CAST AIRFOIL

(75) Inventor: David A. Frey, West Chester, OH (US)

(73) Assignee: General Electric Company, Cincinnati, OH (US)

( * ) Notice: Subject to any disclaimer, the term of this patent is extended or adjusted under 35 U.S.C. 154(b) by 0 days.

(21) Appl. No.: 09/274,167

(22) Filed: Mar. 22, 1999

(51) Int. Cl.[7] ..... B22D 33/04; B22D 27/04
(52) U.S. Cl. ..... 164/137; 164/122.1
(58) Field of Search ..... 164/122.1, 122.2, 164/361, 137

(56) References Cited

U.S. PATENT DOCUMENTS 3,533,712 A * 10/1970 Kercher ..... 416/97
4,148,350 A * 4/1979 Rossman ..... 164/132
4,474,532 A * 10/1984 Pazder ..... 416/97
4,627,480 A * 12/1986 Lee ..... 164/369
5,243,759 A * 9/1993 Brown et al. ..... 29/889.721
5,337,805 A * 8/1994 Green et al. ..... 164/369
5,358,029 A * 10/1994 Baveja et al. ..... 164/516
5,505,250 A * 4/1996 Jago ..... 164/516
6,186,741 B1 * 2/2001 Webb et al. ..... 416/96 R

* cited by examiner

*Primary Examiner*—M. Alexandria Elve
*Assistant Examiner*—Len Tran
(74) *Attorney, Agent, or Firm*—Andrew C. Hess; William Scott Andes

(57) ABSTRACT

A gas turbine engine airfoil is cast around a core having a plurality of legs to form matching flow channels in the airfoil. The legs have a tie extending therebetween to maintain alignment. And, the tie is relocated along the core span to reduce differential static pressure of the cooling air across the resulting tie hole formed by the core tie.

20 Claims, 3 Drawing Sheets

CORE TIED CAST AIRFOIL

The U.S. Government may have certain rights in this invention in accordance with Contract No. F33657-83-C-0281 awarded by the Department of the Air Force.

BACKGROUND OF THE INVENTION

The present invention relates generally to gas turbine engines, and, more specifically, to casting of turbine airfoils therein.

In a gas turbine engine air is pressurized in a compressor and mixed with fuel and ignited in a combustor for generating hot combustion gases which flow downstream through multiple turbine stages that extract energy therefrom. Since the turbine stages are heated by the hot combustion gases, they are typically internally cooled by using a portion of the pressurized air bled from the compressor.

A typical turbine stage includes an annular turbine stator or nozzle having a plurality of circumferentially spaced apart nozzle vanes extending radially between outer and inner bands. Disposed downstream from the nozzle is a row of circumferentially spaced apart turbine rotor blades extending radially outwardly from a supporting rotor disk.

The vanes and blades define airfoils having respective aerodynamic geometries for maximizing efficiency of energy extraction from the combustion gases. A typical airfoil includes a generally concave, pressure side and an opposite, generally convex, suction side extending axially between leading and trailing edges, and radially between a root and a tip.

In a nozzle vane, the airfoil extends radially between the outer and inner bands and is typically formed in a one-piece casting. In a rotor blade, the airfoil tip is spaced from a surrounding turbine shroud, with the root of the airfoil being integrally formed with a dovetail which mounts the blade in a complementary dovetail slot formed in the perimeter of the rotor disk.

Since turbine blades rotate during operation they are subject to considerable centrifugal force and corresponding stress, with the force increasing the complexity of cooling the blade. A typical blade includes an internal cooling circuit formed by multiple, radially extending flow passages or channels through which the cooling air is channeled. The blade airfoil is initially internally cooled by the air which is then discharged through various holes extending though the walls of the airfoil.

Due to the aerodynamic profile of the airfoil, the heat transfer coefficient between the hot combustion gases and the airfoil varies over the pressure and suction sides between the leading and trailing edges and between the root to tip. Accordingly, the internal cooling circuit varies in complexity for best utilizing the limited cooling air to cool the different portions of the airfoil differently in response to the varying heat influx from the combustion gases. Many compromises must be made in defining the internal cooling circuit due to the aerodynamic limitations of channeling the cooling air therethrough, and while balancing the centrifugal and thermal stress experienced by the blade during operation.

A high pressure turbine rotor blade typically includes a dedicated cooling passage or channel behind its leading edge, a dedicated cooling passage behind its trailing edge, and a multi-pass serpentine cooling passage disposed axially therebetween and extending radially between the root and tip of the blade airfoil. The flow passages typically also include turbulators in the form of small ribs extending from the inside surface of the airfoil which trip a portion of the cooling air as it flows radially through the cooling passages for enhancing cooling air heat transfer. The airfoil typically includes several radial rows of film cooling holes extending through the walls thereof for discharging the internal cooling air in corresponding films along the outer surface of the airfoil for providing film cooling thereof.

In order to precisely form the external and internal features of the airfoil, turbine rotor blades are typically cast using high-strength superalloys. In the lost wax method of casting, a ceramic casting core is initially molded to precisely define the internal cooling circuit, including any turbulators or other features desired. The core is then surrounded by wax to define the desired metal portions of the blade, and the wax is then surrounded by a ceramic outer shell.

The wax is removed, and molten metal is injected into the space previously occupied by the wax. The metal solidifies, the shell is removed, and the core is leached away leaving behind the cast blade, including its airfoil and dovetail having the desired precise configurations thereof, both externally and internally. The various holes in the airfoil, such as the film cooling holes, may then be suitably drilled therein.

Some turbine blades, such as stage two blades, have relatively long airfoils which require relatively long casting cores. Since the typical casting core includes multiple legs for matching the multiple internal flow channels of the airfoil, the legs are slender and subject to movement and breakage during the casting process. Misaligned core legs correspondingly change the dimensions of the resulting airfoil, and can lead to out-of-specification locally thick or thin regions for which the airfoil may be rejected. And, core breakage during the casting process also may result in rejection of the cast blade.

As a solution to this problem, it is known to provide one or more core ties between adjacent legs to fixedly join together the legs for reducing undesirable movement therebetween during the casting process and reducing the likelihood of core breakage. However, the ties necessarily define a corresponding tie hole in the intermediate airfoil rib through which a portion of the cooling air being channeled through the flow channels is short circuited. Cooling air short circuits in the complex internal flow channels reduce the cooling efficiency of the available air and correspondingly adversely affect the useful life of the blade during operation.

Accordingly, it is desired to provide an improved method of casting turbine airfoils which reduces the adverse effects of core ties used in the casting thereof.

BRIEF SUMMARY OF THE INVENTION

A gas turbine engine airfoil is cast around a core having a plurality of legs to form matching flow channels in the airfoil. The legs have a tie extending therebetween to maintain alignment. And, the tie is relocated along the core span to reduce differential static pressure of the cooling air across the resulting tie hole formed by the core tie.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
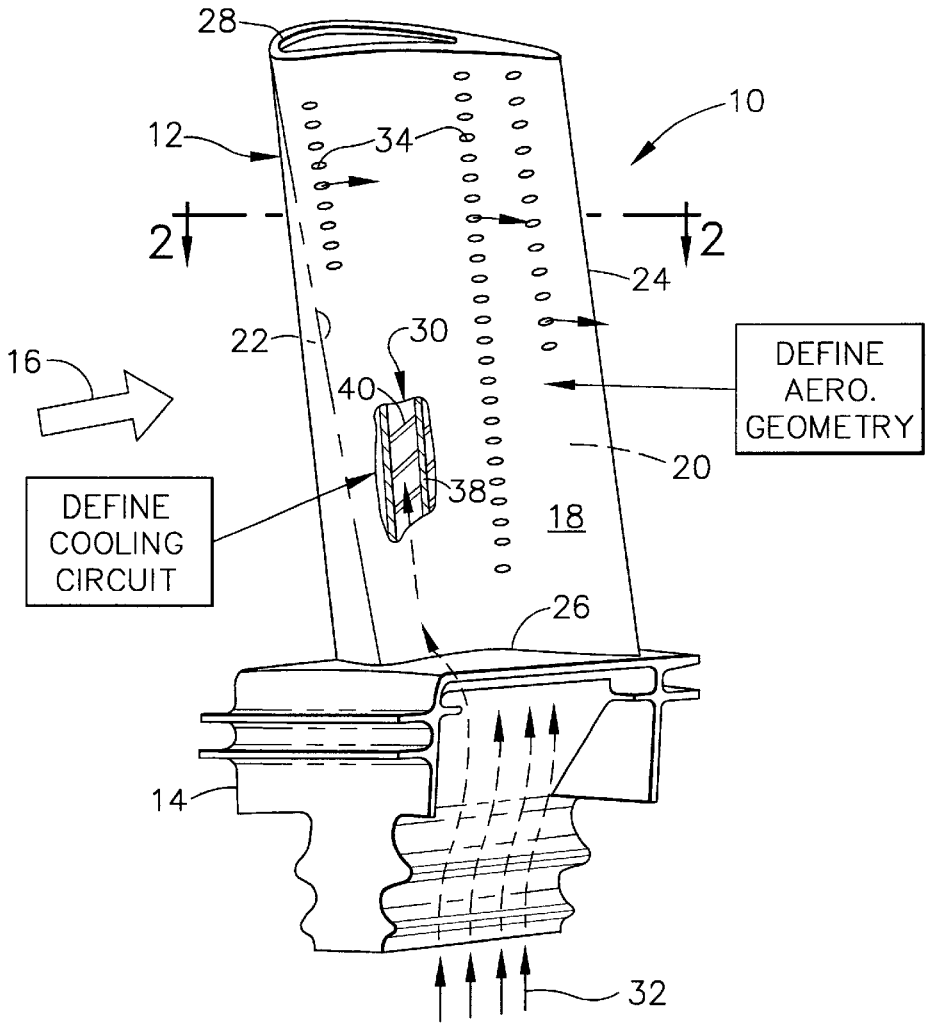
FIG. 1 is an isometric view of an exemplary turbine rotor blade for a gas turbine engine in accordance with an exemplary embodiment of the present invention.

Illustrated in FIG. 1 is an exemplary turbine rotor blade 10 for a gas turbine engine (not shown). The blade is configured as a second stage turbine blade and is therefore relatively long along its radial or span axis as compared to a first stage turbine blade which is shorter.

The blade includes an airfoil 12 and an integral axial-entry dovetail 14 formed in a unitary one-piece casting in accordance with the present invention. The airfoil is configured for extracting energy from hot combustion gases 16 which flow downstream thereover, with the dovetail being disposed in a complementary dovetail slot in a rotor disk (not shown) which is rotated during operation.

Figure 2:
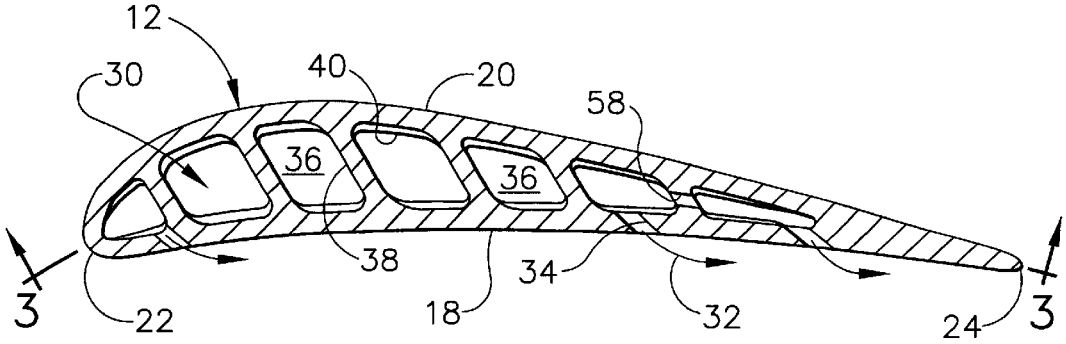
FIG. 2 is a radial sectional view through a portion of the blade airfoil illustrated in FIG. 2 and taken along line 2—2.

The airfoil 12 is specifically configured for each engine application by defining an aerodynamic geometry or outer profile thereof specific to the flowfield of the combustion gases 16 channeled thereover. The airfoil includes a generally concave, pressure side 18, and an opposite generally convex, suction side 20 which extend axially between opposite leading and trailing edges 22,24, and radially along the longitudinal or span axis of the airfoil from a root 26 to a tip 28. A typical radial section through the airfoil is illustrated in FIG. 2 and includes the typical crescent-shaped aerodynamic profile thereof.

Since the turbine blade is heated during operation by the combustion gases 16 which flow over the airfoil thereof, the blade is further specified by defining an internal cooling circuit 30 which extends radially through the dovetail 14 and the airfoil 12 to its tip. The cooling circuit receives pressurized cooling air 32 bled from a compressor (not shown) of the engine. The cooling circuit 30 may take any conventional form for preferentially channeling the cooling air through the different portions of the airfoil for providing corresponding cooling thereof against the varying heat affect of the combustion gases 16.

The air enters the dovetail 14 at its lower end and is discharged from the airfoil through various outlet holes 34 typically in the form of radial rows of film cooling holes which discharge the air in a protective film over the outer surface of the airfoil as a barrier against the hot combustion gases flowing thereover.

Figure 3:
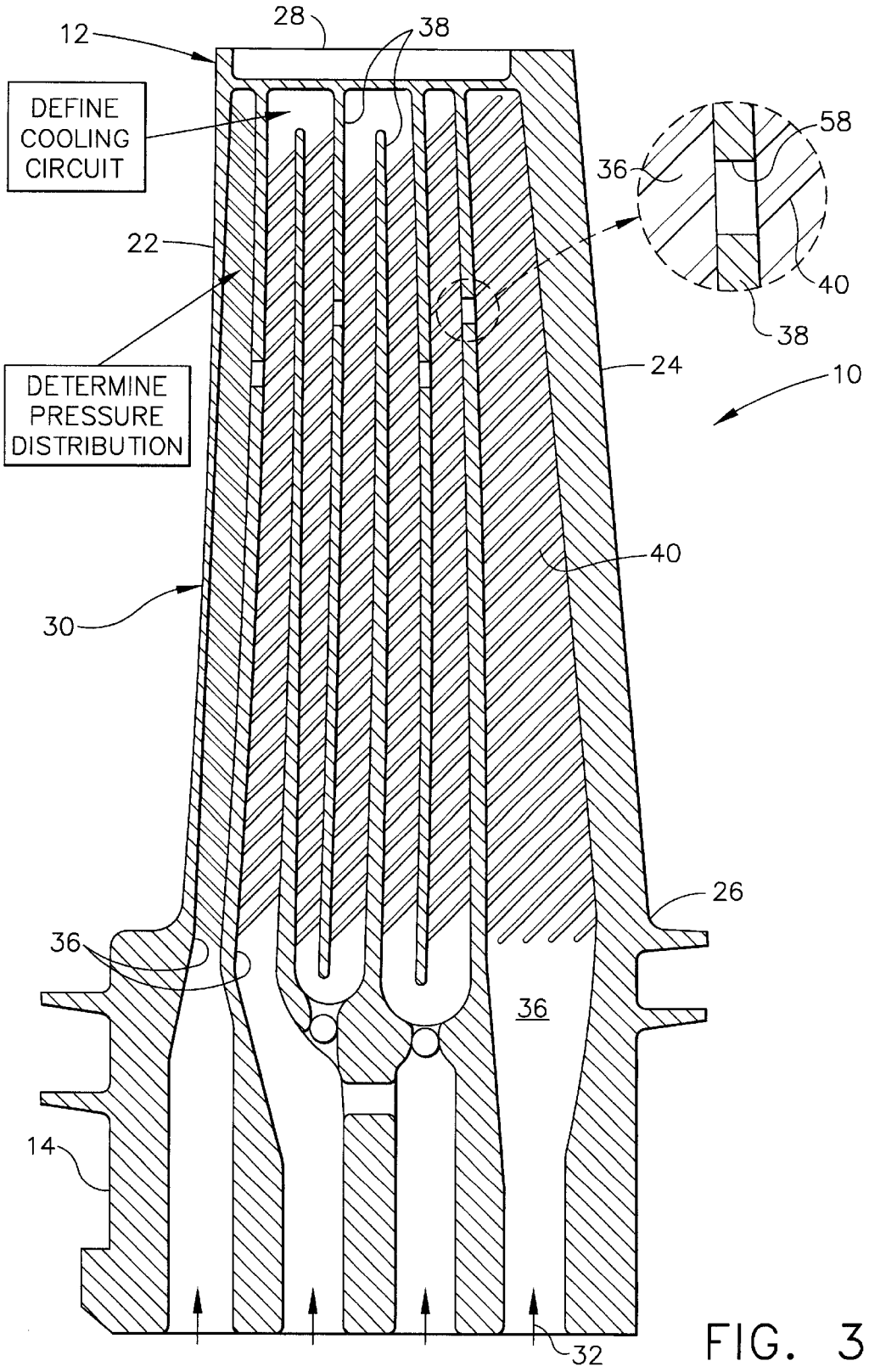
FIG. 3 is an elevational sectional view through the airfoil illustrated in FIG. 2 and taken along line 3—3.

An exemplary embodiment of the internal cooling circuit 30 is illustrated in more detail in FIG. 3. The circuit typically includes a plurality of cooling flow channels 36 extending longitudinally or radially between the root and tip of the airfoil as well as radially through the dovetail. The flow channels 36 extend generally along the radial span of the airfoil and are separated axially from each other by corresponding bridges or ribs 38 which are laterally or circumferentially formed integrally with the pressure and suction sides of the airfoil.

In the exemplary embodiment illustrated in FIG. 3, the cooling circuit 30 includes a dedicated or lone flow channel 36 inside the airfoil behind the leading edge 22, and another dedicated or lone flow channel 36 inside the airfoil behind the trailing edge 24. And, additional ones of the flow channels 36 define a five-pass serpentine flow channel having a first pass behind the leading edge channel and subsequent passes axially therebehind. The five flow channels defining the serpentine are disposed end-to-end with suitable reverse bends near the root and tip of the airfoil so that the last or fifth channel extends outwardly to the airfoil tip immediately adjacent to the trailing edge channel.

These three sub-circuits each include a separate inlet through the dovetail for receiving in parallel the cooling air 32 at the base of the dovetail. The cooling air 32 flows radially through the separate flow channels and loses pressure awhile gaining heat as the airfoil is cooled thereby.

Internal airfoil cooling may be further enhanced by providing corresponding rows of turbulators 40 on either or both sides of the airfoil along the separate flow channels 36. The turbulators trip the cooling air as it flows and further reduce the pressure thereof along the length of the channels.

The turbine blade as above described is conventional in configuration and operation. The outer profile of the airfoil is suitably defined analytically and adjusted as desired during testing thereof for maximizing aerodynamic performance. The cooling circuit 30 may also be defined analytically and modified as desired by testing for maximizing cooling performance thereof. The so defined turbine blade requires mass production with precise reproduction of the outer and inner features thereof. Mass production is typically effected by casting individual blades using the lost wax method, with the wax representing the metallic features of the blade as molten metal replaces the volume previously occupied by the wax.

Figure 4:
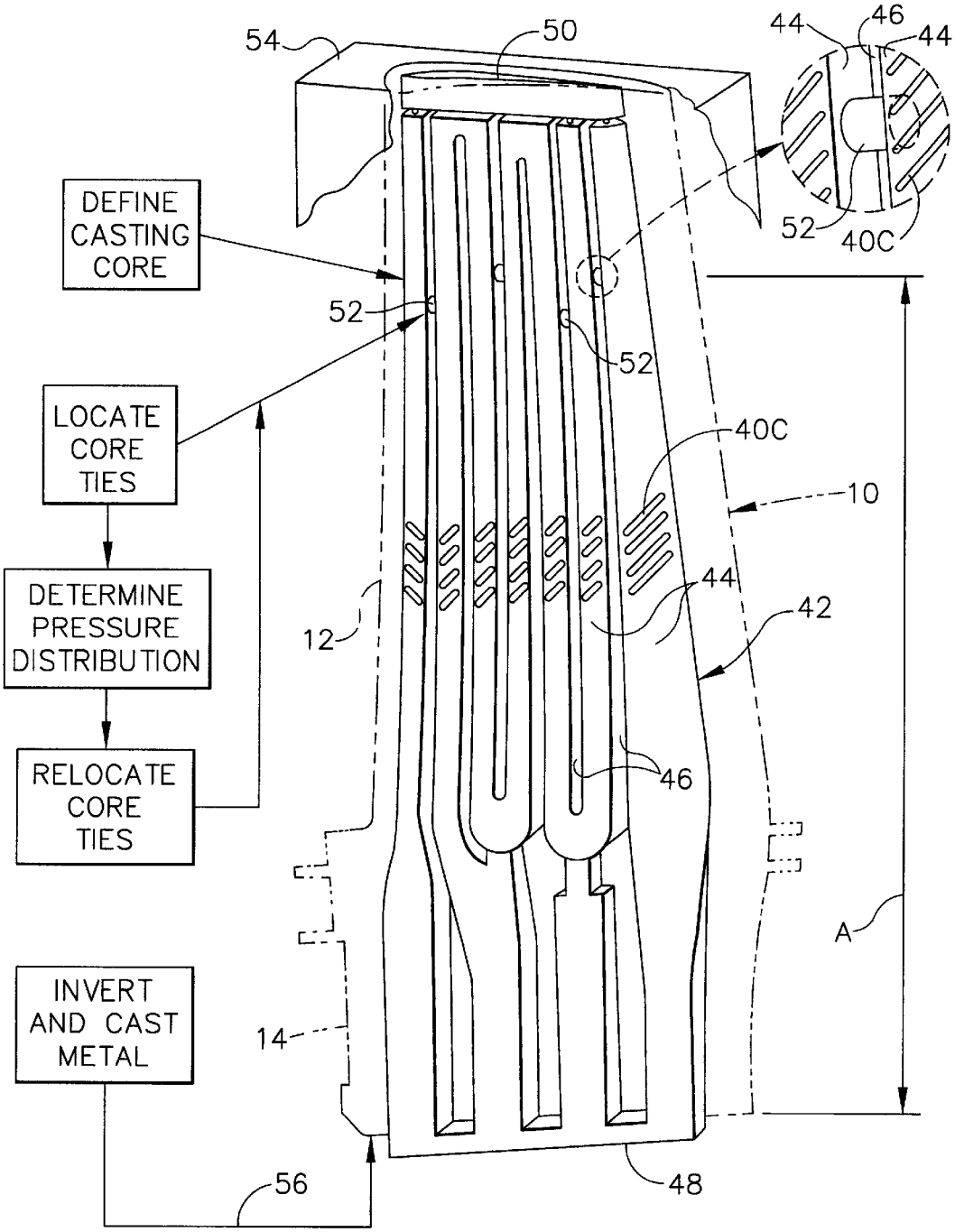
FIG. 4 is an isometric view of an exemplary casting core for casting the turbine blade illustrated in FIGS. 1–3 in accordance with an exemplary method, also shown in flowchart form in the several figures.

FIG. 4 illustrates schematically a method of making the exemplary turbine blade 10 illustrated in FIGS. 1–3 in accordance with a preferred embodiment of the present invention. After the aerodynamic geometry of the blade and the internal cooling circuit 30 are suitably initially defined as shown in FIGS. 1 and 3, a corresponding ceramic casting core 42 is then initially defined or formed to match the internal cooling circuit 30 in any conventional manner.

The core 42 has a plurality of branches or legs 44 which are configured to match respective ones of the flow channels 36 illustrated in FIG. 3. Each of the core legs 44 is axially separated from its neighbor by a corresponding gap 46 which matches the corresponding ribs 38 of the resulting cast blade. Each of the core legs 44 includes corresponding cavities or depressions 40*c* which match respective ones of the turbulators 40. The depressions 40*c* thusly define the respective turbulators 40 when metal is cast therein.

The core 42 has a longitudinal or span axis which corresponds with that of the resulting blade 10 illustrated in phantom outline in FIG. 4. The legs 44 and the intervening gaps 46 extend along the span axis of the core, with the legs being cantilevered from a common support base 48. The individual legs 44 require precise alignment for precisely forming the internal flow channels 36. The common base 48 is formed integrally with the several legs 44 in a unitary casting itself. The base 48 supports the radially inner ends of the several leas 44, and a ceramic cap 50 is suitably attached to the radially outer ends of two or more of the legs 44. The cap 50 defines a corresponding recess in the airfoil tip illustrated in FIG. 3, for example, and defines the bottom of the tip floor which closes the top of the cooling circuit 30.

The core 42 illustrated in FIG. 4 is thusly configured to extend through both the blade airfoil 12 and dovetail 14, with the core base 48 being disposed below the dovetail. For the relatively long stage two turbine blade 10, the corresponding core 42 requires long and slender legs 44 which may be subject to movement and misalignment during the casting process, as well as breakage, in vies of the brittle nature of the ceramic used.

Accordingly, the process of casting the blade also includes locating or defining at least one core tie 52 between two adjacent ones of the core legs 44 to maintain fixed alignment therebetween for ensuring proper size of the gap 46 and the resulting proper thickness of the corresponding ribs 38, as well as correct wall thickness of the airfoil. One or more of the core ties 52 may be used as required to maintain alignment of the legs 44 and reduce the likelihood of core breakage during casting.

The number and position of the core ties 52 may be determined in any conventional manner for maintaining precision and integrity of the core 42 itself during the casting process. Manufacture of the core and its ties, and blade casting are typically accomplished by vendor companies specializing therein. For example, the casting of superalloy turbine blades may be performed by Howmet Corporation, Whitehall, Mich. which has proven experience developed over many years of commercial production in this country.

In the lost wax method of casting, wax (not illustrated) is cast around the core 42 using a master mold (not shown) to define the outer profile of the blade, including its airfoil and dovetail. The mold is removed and a ceramic shell 54, shown in part in FIG. 4, is built around the wax. The wax is then removed by melting for leaving a void or gap between the shell 54 and the core 42 suitably mounted therein.

Molten metal 56 is then poured or injected into the casting void to completely surround the core as bounded by the shell. The metal is then solidified followed by removal of the shell 54 and leaching away of the core 42 for leaving behind the cast blade 10 illustrated in FIGS. 1–3. The various holes 34 may then be conventionally drilled through the outer surface of the airfoil for providing outlets for the cooling air channeled therethrough during operation.

Although the core ties 52 may be desirable for maintaining alignment of the core legs 42 and reducing the likelihood of core breakage during casting, they correspondingly form undesirable tie holes 58 as shown in FIGS. 2 and 3. But for the tie holes 58, the corresponding ribs 38 are preferably imperforate in the preferred embodiment, with the tie holes being a necessary consequence of using the core ties.

As shown in the exemplary configuration illustrated in FIG. 3, there are four tie holes 58 formed in the intermediate ribs 38 corresponding to the four core ties 52 illustrated in FIG. 4. The number of core ties and their initial positions are initially determined solely by the mechanical requirements for maintaining alignment of the core legs and reducing core breakage during the casting process.

The resulting tie holes 58 accordingly provide short circuits in the predefined internal cooling circuit 30 which adversely affects cooling performance thereof. In the hostile operating environment of a gas turbine engine, the small adverse affect created by the tie holes 58 can significantly adversely affect the useful life of the blade during operation. Reduced cooling performance can occur from the tie holes 58 subjecting the airfoil to additional thermal stress during operation and reducing the cycle life thereof.

However, and in accordance with the present invention, the tie holes 58 may be preferentially relocated along the span of the airfoil to minimize their adverse affect on airfoil cooling. More specifically, and as shown in FIG. 3, an improved process of making the blade includes additionally determining the internal static pressure distribution of the cooling air 32 across each of the intermediate ribs 38 in which a corresponding tie hole 58 is located. The static pressure distribution inside the airfoil may be determined in any conventional manner, such as using a one-dimensional mathematical analysis given the internal geometry of the cooling circuit 30 and the typical cooling parameters of the cooling air 32 channeled through the blade. The static pressure distribution is determined preferably without including the tie holes 58, with the intermediate ribs being otherwise imperforate.

In this way, the adverse affect of including the tie holes 58 in the intermediate ribs may be determined based on the expected effect of the short circuits provided by the tie holes. The internal static pressure distribution in the airfoil is affected by the specific configuration and lengths of the several flow channels 36. As shown in FIG. 3, the leading and trailing edge flow channels have a single pass and perform differently than the five-pass serpentine flow channels therebetween.

All three sub-circuits receive respective portions of the common cooling air 32 at the base of the dovetail, with the air losing pressure differently and absorbing heat differently in each of the three circuits. Furthermore, since the blade rotates during operation, the cooling air is subject to centrifugal force which locally pumps the air for increasing its pressure greater near the tip of the airfoil than near its root.

Accordingly, for each of the desired locations of the core ties 52 which create the tie holes 58, the differential static pressure across the respective tie holes 58 may be determined. If that differential pressure or pressure drop is near zero, the tie hole will have little adverse affect on blade cooling. If the pressure drop is large, cooling air will short circuit through the tie hole and adversely affect blade cooling in the corresponding flow channel deprived of its full complement of cooling air.

In accordance with the present invention, each of the initially defined core ties 52 may be relocated along the core span to reduce the differential static pressure across the corresponding tie hole 58. As shown in FIG. 4, each of the core ties 52 has a span position or height A measured from the common base 48. The span height of the individual core ties 52 is initially determined by the mechanical requirements to maintain precise alignment between the slender core legs 44 and reduce core breakage.

The span heights of the respective core ties 52 may then be adjusted following determination of the pressure distribution inside the airfoil for reducing the differential pressure across the tie holes. In this way, the core ties 52 may be repositioned to reduce their adverse affect on airfoil cooling in a compromise with alignment of the legs and core breakage during casting.

The final casting core 42 is therefore preferably formed with the relocated core ties 52 for improving the location of the resulting tie holes 58 for increasing cooling performance and life of the airfoil. The blade and its airfoil is then normally cast using the reconfigured core 42 in a conventional manner using the lost wax method.

In the exemplary embodiment illustrated in FIG. 4, the core legs 44 are cantilevered at their lower base ends from the common support base 48, and are tied together at their outer ends by the cap 50. Since the legs 44 are long and slender, misalignment between the five-pass serpentine legs and the lone leading and trailing edge legs is a concern. One or more of the core ties 52 is therefore preferably located near the upper ends of the legs opposite to their base ends. And, one or more of the core ties 52 is preferably relocated further from the base 48 and closer to the outer ends of the legs for reducing the pressure drop across the corresponding tie holes 58.

As the cooling air flows radially outwardly through the several flow channels illustrated in FIG. 3, it is subject to friction losses, heat gain, and centrifugal pumping. The five-pass serpentine flow channels illustrated in FIG. 3 alternately channel the cooling air radially outwardly in the direction of centrifugal pumping and radially inwardly against the direction of centrifugal pumping. When the cooling air reaches the last pass of the serpentine flow channel directly adjacent the trailing edge flow channel, it has lost significant pressure and has absorbed heat.

A significant pressure differential will therefore exist between the last pass serpentine channel and the trailing edge channel from root to tip of the airfoil. And, by relocating the tie hole 58, and its corresponding core tie 52, closer to the airfoil tip, differential pressure across the tie hole may be reduced due to the significant centrifugal pumping of the cooling air. Correspondingly, at other locations of the tie holes, they may be relocated radially inwardly closer to the airfoil root than they would otherwise be without considering the differential pressure thereacross.

Accordingly, for the serpentine flow channels 36 illustrated in FIG. 3, the corresponding casting core 42 illustrated in FIG. 4 includes matching legs 44 disposed end-to-end in a serpentine configuration from the base 48, with the lone trailing edge leg also extending from the base to adjoin the last serpentine leg at the corresponding core tie 52.

In the exemplary embodiment illustrated in FIG. 4, the core 42 includes an additional core tie 52 disposed between the adjacent second and third legs of the serpentine configuration for maintaining alignment therebetween. And that core tie 52 may be suitably relocated for reducing the differential pressure acting across the corresponding tie hole 58 between the second and third flow channels 36 of the serpentine configuration illustrated in FIG. 3.

In the specific embodiment illustrated in FIG. 4, four of the core ties 52 are used to adjoin respective core legs 44, with each of the core ties 52 being staggered from each other along the core span. Correspondingly, the resulting tie holes 58 illustrated in FIG. 3 are also staggered along the airfoil span. Since the internal pressure distribution from channel to channel in FIG. 3 will vary, the individual tie holes, and corresponding core ties, may be relocated either radially outwardly or radially inwardly as the specific pressure distribution dictates for reducing the corresponding pressure drops thereacross.

Accordingly, the resulting turbine blade 10 has tie holes 58 which are differently located along the airfoil span for reducing air short circuits, than they would otherwise be located based on maintaining alignment and integrity of the casting core. The relocated core ties 52 and corresponding tie holes 58 enjoy the benefit of accurate casting with reduced core breakage, with the additional advantage of decreasing the adverse affect of the cooling air short circuits provided by the tie holes 58. The airfoil therefore enjoys improved cooling which can lead to an improved useful life thereof not previously available for the same design without relocated tie holes.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims in which I claim:

1. A method of casting a gas turbine engine airfoil around a casting core having a plurality of legs to form matching flow channels in said airfoil separated by ribs for channeling cooling air, comprising:

locating a core tie between two of said core legs to maintain alignment therebetween, with said tie defining a corresponding tie hole in an intermediate one of said ribs;

determining internal static pressure distribution of said cooling air across said intermediate rib;

relocating said core tie along a span of said core to reduce differential static pressure of said cooling air across said tie hole formed by said core tie;

forming said core with said relocated core tie; and casting said airfoil using said core.

2. A method according to claim 1 further comprising:

cantilevering said core legs at one end from a common support base;

locating said core tie near an opposite end of said legs; and relocating said core tie further from said base.

3. A method according to claim 2 wherein said core comprises legs disposed end-to-end in a serpentine configuration from said base, and a lone leg extending from said base adjoining said serpentine legs at said core tie.

4. A method according to claim 3 wherein said core further includes another one of said core ties disposed between adjacent legs of said serpentine configuration.

5. A method of making a gas turbine engine airfoil comprising:

defining an aerodynamic outer profile of said airfoil;

defining an internal cooling circuit of said airfoil including a plurality of flow channels separated by ribs extending longitudinally along a span of said airfoil for channeling cooling air;

defining a casting core to match said cooling circuit, with said core having a plurality of legs matching respective ones of said channels and being cantilevered along a span of said core from a common support base;

locating a core tie between two of said core legs to maintain alignment therebetween, with said tie defining a corresponding tie hole in an intermediate one of said ribs;

determining internal static pressure distribution of said cooling air across said intermediate rib;

relocating said core tie along said core span to reduce differential static pressure across said tie hole;

forming said core with said relocated core tie; and casting said airfoil using said core.

6. A method according to claim 5 wherein said core comprises legs disposed end-to-end in a serpentine configuration from said base, and a lone leg extending from said base adjoining said serpentine legs at said core tie.

7. A method according to claim 6 wherein said core further includes another one of said core ties disposed between adjacent legs of said serpentine configuration.

8. A method according to claim 7 wherein one of said core ties is relocated further from said base.

9. A method according to claim 8 wherein said core ties are staggered from each other along said core span.

10. A method according to claim 9 wherein said airfoil forms part of a turbine rotor blade further including an integral dovetail, and said core is configured to extend through both said airfoil and dovetail, with said core base being disposed below said dovetail.

11. An airfoil made by the method of claim 1.

12. An airfoil made by the method of claim 2.

13. An airfoil made by the method of claim 3.

14. An airfoil made by the method of claim 4.

15. An airfoil made by the method of claim 5.

16. An airfoil made by the method of claim 6.

17. An airfoil made by the method of claim 7.

18. An airfoil made by the method of claim 8.

19. An airfoil made by the method of claim 9.

20. A turbine rotor blade made by the method of claim 10.

* * * * *